US008776333B2

(12) United States Patent
Van Den Bogart

(10) Patent No.: US 8,776,333 B2
(45) Date of Patent: Jul. 15, 2014

(54) PERSONALIZED CONTAINER

(76) Inventor: Thomas William Van Den Bogart, Slinger, WI (US)

( * ) Notice: Subject to any disclaimer, the term of this patent is extended or adjusted under 35 U.S.C. 154(b) by 171 days.

(21) Appl. No.: 12/978,674

(22) Filed: Dec. 27, 2010

(65) Prior Publication Data

US 2011/0154626 A1 Jun. 30, 2011

Related U.S. Application Data

(60) Provisional application No. 61/291,401, filed on Dec. 31, 2009.

(51) Int. Cl.
*A61G 17/00* (2006.01)

(52) U.S. Cl.
USPC ..... 27/1; 27/4; 283/67; 705/26.5

(58) Field of Classification Search
USPC ..... 27/1, 2, 19, 4; 40/124.5, 312, 638; 101/92; 283/67; 705/26.5
See application file for complete search history.

(56) References Cited

U.S. PATENT DOCUMENTS

| | | | | |
|---|---|---|---|---|
| 4,585,254 | A * | 4/1986 | Adams | 283/81 |
| 6,086,702 | A * | 7/2000 | Rea | 156/247 |
| 6,800,167 | B1 * | 10/2004 | Frazer | 156/249 |
| 7,080,916 | B1 * | 7/2006 | Ferrin et al. | 362/96 |
| 7,340,417 | B2 | 3/2008 | Kaufman et al. | |
| 7,552,070 | B2 | 6/2009 | Torres et al. | |
| 7,571,809 | B2 * | 8/2009 | Yahiel | 206/459.5 |
| D622,024 | S | 8/2010 | School | |
| 8,046,881 | B2 * | 11/2011 | Johnson et al. | 27/1 |
| 8,365,451 | B2 * | 2/2013 | Seidl | 40/638 |
| 2008/0077415 | A1 | 3/2008 | Shannon et al. | |
| 2008/0129035 | A1 | 6/2008 | McDonald et al. | |
| 2009/0030804 | A1 | 1/2009 | Sell | |

OTHER PUBLICATIONS

Web page entitled "In Memorium Photo Personalized Urn," from a Web site for a business identified as In The Light Urns, (2009); retrieved Oct. 21, 2009 from http://inthelighturns.com/catalog/product_info.php?cPath+51&products_id=1632.

Web page entitled "Local Casket Customizer Sees Rapid Growth in Niche Industry," from a Web site entitled GazetteXtra (article dated Monday, Mar. 28, 2011); retrieved Sep. 19, 2011 from http://gazettextra.com/news/2011/mar/28/local-casket-customizer-sees-rapid-growth-niche-in/.

Web page entitled "HeartFelt KeepsakeTM Single—Custom," from a Web site for a business identified as Davis Whitehall Co.; retrieved Sep. 23, 2011 from http://www.davis-whitehall.com/product/268.

* cited by examiner

*Primary Examiner* — William Miller

(57) ABSTRACT

A process for making a personalized container, such as an urn for ashes, a temporary coffin, or a box for memorabilia, that includes the steps of receiving instructions specifying a personalized panel to be disposed on the container; and disposing the personalized panel, typically by digital ink-jet printing, on a web such as paper, paperboard, film, laminate, or some combination thereof, in accordance with the received instructions. Generally the web, when printed, is continuous, and moving. In subsequent unit operations, the web is separated into web portions, each web portion comprising a personalized panel, with the web portion converted into a personalized container. The personalized container may employ other cues to help evoke memories of one absent, such as a recorded voice, or scent.

11 Claims, 4 Drawing Sheets

PERSONALIZED CONTAINER

This application claims priority to U.S. Provisional Patent Application No. 61/291,401, entitled "Personalized Container" and filed on 31 Dec. 2009, the substance of which is incorporated herein by reference.

BACKGROUND

People increasingly want products and services tailored to them. Manufacturers and service providers often meet this need by providing options from which people choose. For example, a manufacturer of portable music players (e.g., an iPod-brand music player) may provide the player in ten colors. The purchaser gets some level of personalization by choosing a color she likes. If the product is popular, then other people, perhaps millions of other people, pick the same color. And so, in reality, the level of customization is limited. Perhaps the manufacturer gives purchasers the option of engraving the music player. For more time and money, the customer is able to personalize the player a bit more. This example shows that a manufacturer of music players, like other manufacturers and service providers, must make a compromise between providing a high level of customization, with its attendant costs (typically in increased time to manufacture, and more money), and a low level of customization, which may not be what the customer wants or needs. At the margin, a manufacturer cannot provide a unique and highly customized product tailored to each individual customer. This is especially true if there are many customers, each one wanting their chosen product quickly, and at high quality.

So it is with the death-care and related industries. Many customers, including, for example, survivors, persons making arrangements for their own deaths—whether imminent or not, and persons foreseeing their own absence, seek to buy a container, for various purposes relating to absence, and one that is uniquely theirs (with death being the ultimate absence; yet, as Alexander Pope wrote: "Say, is not absence death to those who love?").

Thus providers of urns, temporary coffins, memory boxes, keepsake containers, and the like seek to offer different options from which people choose. Though this may not always be the case. Temporary coffins, for example, are often used to contain the body of a loved one prior to cremation. Given their temporary nature, and the fact that the temporary coffin is incinerated with the body, the level of personalization offered by manufacturers or service providers for such containers is likely low, or non-existent. For the same reason, temporary urns—those used to hold the ashes of the deceased prior to sprinkling (i.e., dispersing the ashes into the environment)—may not be highly customizable.

Other containers, such as keepsake containers, memory boxes, or urns, show a range of customization. For those having money and time, a skilled artisan can be engaged to carve, sculpt, paint, or otherwise create a unique container. Most people, however, lack the resources necessary for this kind of personalization. For those needing a product quickly, or who choose not to spend large sums, the available options for customization are generally limited. Typically such customers leaf through a catalogue, or Internet Web pages, and select a design. Perhaps the customer is given the option of attaching a sentiment to, or engraving a sentiment on, the selected design. In some cases the customer may choose to have the picture of a loved one attached to the chosen container.

While the preceding approaches provide different levels of personalization, there remains a need for personalized, affordable containers including, for example, urns, temporary coffins, and boxes for memorabilia, that people can design and view before purchasing; and ways of making such containers.

SUMMARY

I have determined that affordable, personalized containers relating to absence—what I call Celebration-of-Life™ containers—can be made using a web (e.g., paper, paperboard, film, and laminates thereof) on which is disposed a personalized panel, or panels, comprising design elements that include, for example, graphic elements (i.e., visually observable elements) such as text, clip art, pictorial themes, uploaded content (e.g., a picture of a loved one that is scanned and converted into a digital file such as a portable display file (i.e., a ".pdf" file), background color(s), and the like (note: the personalized container may comprise design elements that are not graphic elements in the sense that the design element is visually observable—e.g., design elements may be detected by the senses of touch, smell or hearing). The personalized panel is typically disposed on the web by a digital printing unit operation in response to instructions received over a communications network. In a preferred version of the inventive process, the instructions are received after an image of the corresponding personalized container is transmitted over a communications network for display on a screen viewable by the customer who designed, and is ordering, the personalized container. In this way the customer is able to see their personalized design, perhaps after numerous design changes, before ordering the personalized container. In effect, if a person can conceive a design that they wish to dispose on a personalized container, then representative versions of the invention provides the tools by which the person can create a personalized panel—i.e., a graphic image comprising text, images, and other ornamental features—that expresses their conceived design.

The inventive processes, and corresponding articles of manufacture, address one or more recent trends, as well as important needs of people dealing with absence, including end-of-life decisions. First, people are becoming used to, and demanding, high levels of customization, at a reasonable cost. The inventive process addresses this perceived need for those wanting to buy personalized containers relating to absence. Second, in times of recession, people seek to be better stewards, both of personal resources, and of the environment as a whole. Because representative versions of the invention may be operated at reasonably high speeds, while at the same time affording the potential of high levels of customization, customers may design, and purchase, highly personalized Celebration-of-Life™ containers at a reasonable price. Furthermore, webs comprising recycled materials, biodegradable materials, renewable materials, or some combination thereof, can be used to make the inventive containers. Third, a survivor using representative versions of the inventive process may find the experience cathartic, especially if he or she, alone or with others, views multiple iterations of different designs before ordering. Accordingly, some inventive methods comprise the step of transmitting a statement relating one or more therapeutic, emotional, or other possible benefits to disclosed methods of making personalized containers. Note, too, that the inventive process accommodates the design and order of personalized Celebration-of-Life™ containers from the privacy of ones own home, or, if desired, in the presence of a person experienced with end-of-life issues, aesthetic and practical issues implicated by different design elements of a personalized death-care container, or both.

Typically a personalized panel, which may encompass design elements such as selected text (e.g., a line from a favorite poem, a nickname or common phrase used by the deceased, or other phrase or text), uploaded content (such as a picture of the deceased in the form of a .pdf file, or other such file), graphic themes or backgrounds (e.g., natural environments such as the beach, a forest, or the sky; pursuits such as fishing or hunting; sports including football or baseball; etc.), clip art (e.g., military symbols, the flag, etc.), and the like, is imparted to the web through a digital process, such as digital ink-jet printing, which provides for high-levels of customization while avoiding set-up costs and time, which may be significant, especially as the level of customization increases (e.g., preparing plates for conventional offset printing processes—one for each personalized panel—and setting up a printing machine to employ these plates—takes time and money). Frankly, many printing processes are not suited to high levels of customization, nor the short time frames within which customers need some types of personalized containers (e.g., an urn for a recently deceased person or pet). Even while affording high levels of customization, processes employing digital printing operations can be operated at speeds exceeding 100 feet per minute, even 1000 feet per minute, thus allowing for the manufacture of high numbers of personalized death-care containers (or containers relating to absence), at a reasonable cost.

In some versions of the process, after the personalized panel is disposed, typically by digital printing, on the web, the web is then processed further to make the personalized container that was ordered by the customer (with the personalized panel then part of one or more walls of the personalized container—e.g., one or more of the interior and/or exterior of a sidewall, top wall, and/or bottom wall of the personalized container). A number of unit operations may be employed to further process the printed web, including, for example, cutting, folding, or joining operations. The web itself may be converted directly into the personalized container, or may be joined to one or more additional components. Of course, in a continuous process, a queue or array of received instructions (e.g., a first set of instructions corresponding to a first personalized panel; a second set of instructions corresponding to a second personalized panel; and so on, with each set of instructions corresponding to a different customer order and personalized container; or, alternatively, or in addition to, each instruction set corresponding to a different customer order and a different personalized container, cases where one customer order corresponds to two or more personalized panels, with each of these personalized panels to be disposed on a single personalized container, such as on a surface outside the container, and on a surface inside the container) is processed so that a sequence of personalized panels is disposed on the web, with each personalized panel corresponding to a set of instructions in the queue or array. The web, then, is separated into web portions, each web portion having a unique personalized panel disposed thereon, which is then converted into a personalized container bearing the personalized panel.

As discussed above, a personalized container may include more than one personalized panel designed by a customer. For example, a container having the shape of a parallelepiped can have a personalized panel disposed on 6 different faces on the outside of the container (i.e., 4 sides, top, and bottom of the parallelepiped) and 6 different faces on the inside of the container. A container having a circular or oval cross-section can have a personalized panel on 3 different faces on the outside of the container (i.e., the curvilinear side defining the circle, oval, or elliptical cross-section; top; and bottom) and 3 different faces on the inside of the container. Also, even though a cylindrical or oval container includes, in effect, one continuous curvilinear side, that one continuous side can include multiple personalized panels (e.g., a personalized panel on the front portion of the side of the container, and a second personalized panel on the back portion of the side of the container).

During the unit operation in which a personalized panel is disposed on the web—again, typically by a digital printing operation—the web is often conveyed continuously. Generally the web is in a substantially laid-flat orientation when receiving the personalized panel, although it can assume a curved orientation. Continuous movement of the web allows for higher speeds of operation. Higher speeds of operation, in turn, can provide for the manufacture of more highly customized containers per unit time, likely resulting in a lower cost per container. Note, however, that in some versions of the invention, a cut-sheet process is used to dispose a personalized panel on a substrate, with this substrate then joined to other components to make the personalized Celebration-of-Life™ container.

In one representative embodiment of the invention, the web, which is initially in roll form, is placed on an unwind stand. The web, then, is unwound and conveyed to a unit operation in which a personalized panel is disposed on the web, typically by digital printing, in response to instructions received over a communications network. As noted above, the personalized panel, which was designed and created by the customer ordering the corresponding personalized container on which the panel is printed, can include, for example, one or more of the following representative graphic elements: text; images; background patterns, colors, or both—often chosen to match or be consistent with other design elements, such as uploaded photographs, drawings, or the like; ornamental features selected from a menu of such features; clip art; and other such elements (including, as is discussed elsewhere sound files, aromas, textures, and the like; with the sound, aroma, or texture then tangibly embodied in the personalized container—e.g., an electronic sound chip for sound; a material that emits one or more volatile compounds such that a scent or aroma is perceived; etc.). Typically a customer will have viewed the personalized container they designed, for example, on a computer monitor before ordering the container. In some versions of the invention, the customer is able to see different views of the container. For example, in some versions of the invention, the customer uses a point-and-click device such as a mouse to position a cursor over arrows displayed near the image of the personalized container. By clicking on the selected arrow, the image rotates in response to the customer's actions, thus providing the customer with different views of the container. The ability to see the personalized container from different vantage points, whether by this or other representative methods discussed below, is advantageous for those instances where the customer designs different panels to be disposed on different sides or portions of the container. Also, as noted elsewhere, this iterative process of design, in which a customer designs, and then sees, the resulting container, may prove to be a cathartic and helpful experience for those designing urns for a pet or a loved one who has passed on.

By viewing the container in this manner, a customer can be satisfied that his or her design choices, which may be numerous, result in a personalized Celebration-of-Life™ container that meets his or her needs, and that looks the way the customer wants it to look. The image of the personalized container that is displayed on the monitor or screen substantially corresponds to the personalized container that will be made in response to the customer's order and corresponding instructions. In this way, what the customer sees on the computer screen (or other visual display) is essentially what the customer gets (this form of visual display is sometimes denominated as "what you see is what you get," or, in the form of an initialization, "WYSIWYG"). Of course this ability to see WYSIWYG images of the personalized container allows a customer to try many different combinations of design elements prior to ordering a specific, personalized container.

The inventive processes may be employed in various ways. For example, the unit operation, or operations, by which a personalized panel is disposed on the web may be in-line with unit operations by which the web is converted into a personalized container. Or, alternatively, the web on which a personalized panel is disposed may be processed (e.g., wound up on a reel) and then moved to another location (whether at the same geographic location or a different geographic location) for further processing to form the personalized container. In some representative versions of the invention, a cut-sheet process is used to dispose personalized panels on a substrate, with this substrate then married to other components to make the personalized container. Typically such relatively high-speed, cut-sheet processes are capable of producing 50,000 to 5,000,000 or more images per month.

In order to accommodate a relatively high volume of orders, and therefore relatively high operating speeds, representative versions of the process may employ multiple productions lines. For example, if paperboard is used as a material to construct a personalized container, and if the paperboard is cut into an appropriate blank for conversion into a container, then one converting line may be employed for each container size, thereby avoiding grade changes and set-up times for changing from one size to another. In one representative version of the invention, one continuous or cut-sheet digital printing operation is used to dispose personalized panels onto the web or substrate in accordance with received instructions. Web portions or sheets on which these personalized panels are disposed are then married to the paperboard containers (e.g., using adhesive, pressure, or an overwrap), either before the blanks are folded and otherwise converted into containers, or after the blanks have been converted into containers.

Note, too, received instructions may specify other design elements of the personalized container including, for example: the number of items ordered; the size and shape of the container (e.g., oval, cylinder, oblong, etc.); the choice of materials of constructions; etc. Furthermore, the types of personalized containers that may be made include, as noted above, urns (temporary or for extended use), memory or keepsake containers (i.e., containers used for memorabilia, often in contemplation of a temporary or permanent absence), temporary coffins (which are used primarily for cremation), and the like. Also, such personalized containers may be used for deceased persons, deceased pets, and/or memorabilia.

The inventive processes, and resulting articles of manufacture, may be used by survivors of a recently deceased person, pet owners, persons making their own arrangements in preparation for their own death, people anticipating an absence, and other such customers.

In some representative versions of the invention, the personalized container includes means of storing information that can to be accessed by others. For example, in one embodiment, the container includes a sound chip on which is recorded the voice of the deceased, or soon-to-be deceased, or one absent from another and which may be played by activating the sound chip, either directly, using an on-off switch connected to the chip (including, for example, an on-off switch that is activated by opening or removing a cover to the container); remotely, using a separate device that interacts with the sound chip (e.g., a remote control device, or by a portable electronic device incorporating an application, and hardware for wireless communication, such that the portable electronic device is configured to activate the sound chip); or remotely due to light, motion, or noise events that trigger the sound chip.

In one representative version of the invention, the sound or voice to be recorded is transmitted over a hard-wired telephone line (or wirelessly), with the transmitted sound or voice being recorded on a sound chip or other electronic or tangible medium such that the recorded sound may be played back. In some versions of the invention, a user, after transmitting the sound, is able to hear the sound prior to the user ordering a personalized container with which the sound is to be associated. If the user is not satisfied with the sound recording, then the user may delete, modify, re-record, or otherwise change the sound prior to ordering the personalized container. Once the user is satisfied with the sound recording, he or she can then order the personalized container with the sound recording embodied in a tangible medium associated with the personalized container, such as a sound chip. Note that the tangible medium may not be attached to the personalized container itself. Instead, the sound chip may be attached to a placard, card, case (e.g., a case similar in size to a case for carrying business cards), box, picture, or other object separate from the personalized container. The object may comprise one or more design elements that are the same or similar to design elements selected for the personalized container. In other words the object embodying the sound recording and the personalized container may present a common theme incorporating one or more of the same or similar design elements.

Some representative versions of the invention include other elements that serve to help trigger the senses of those viewing the personalized container. As mentioned above, the personalized container can include a device that reproduces a sound recording pertaining to, for example, a deceased person. In addition to, or as an alternative to, sound, the personalized container can include ingredients or chemistries corresponding to a scent, thus using the sense of smell to evoke memories or thoughts (e.g., memories of one who has passed on). If, for example, a loved one who has passed on enjoyed the scent of lilac, then ingredients or other volatile chemistries that correspond to the scent of lilac could be incorporated into one or more components of the personalized container (e.g., by including microencapsulated ingredients in a component so that, when the microencapsulated materials are released, e.g. by pressure, the scent is released).

The personalized container can include more than one compartment (e.g., in the case of an urn, a compartment for ashes, and a compartment for memorabilia). It should be understood generally that the various packaging forms employing paper, paperboard, films, and laminates thereof, may be adapted and configured for use in the manufacture of personalized containers on which are disposed highly-customizable, personalized panels that correspond to instructions received over a communications network.

These and other representative embodiments of the personalized Celebration-of-Life™ container, and processes for making such personalized containers, are described below.

DRAWINGS

FIG. 1 schematically shows a representative version of a method for making a personalized container.

DESCRIPTION

Before describing the invention in greater detail, a recap of possible benefits is helpful. First, representative versions of the invention provide, typically at lower cost, a way by which highly personalized Celebration-of-Life™ containers may be designed, and ordered, over a communications network. Instructions received over the communications network specify aspects of the personalized container—e.g., a personalized panel, or panels, reflect the customer's unique design. The personalized panel(s) is then disposed on a web that is converted into the personalized container. Furthermore, the manner by which these personalized containers are made provides this customization capability to large numbers of customers, with each customer usually receiving his or her order the next day, or within days of ordering. This is so because a web, such as paperboard, may be conveyed through a manufacturing process, printed in response to instructions conveyed over a communications network, and converted into personalized containers at speeds greater than artisans or individuals can manually customize containers. Thus the invention counters the basic proposition that high levels of customization require more time, money, or both. Also, because each customer sees his or her personalized container before ordering, there is a lower chance of customer complaints. In addition, survivors may find an iterative design process (i.e., a process in which the customer makes design choices, views an image of a personalized container incorporating those changes; then makes additional or different design choices, and views a second image that incorporates these additional or different design choices; etc.) helpful to the grieving process. In effect, representative versions of the process give real-time feedback to the consumer as to the appearance of the personalized container that they are designing. And the customer, if he or she desires, is able to design the personalized container from the privacy of his or her own home with or without the help of others. Such an option is important to those who deal with loss, and attendant sorrow, by remembering and thinking about the deceased—with such reflection enhanced by stimuli that helps evoke recall of the deceased (e.g., seeing photographs of the deceased; by creative processes—such as scrap booking—in which a person sees and handles photographs of loved ones while making something new to memorialize the person who has passed on; in some ways, representative versions of the invention are akin to aspects of scrapbooking). Alternatively, customers may make use of representative embodiments in the presence of persons skilled in design, experienced with end-of-life issues (e.g., psychological issues; logistics of end-of-life events; and the like), or both.

Overview of a Representative Version of the Process

Figure 1:
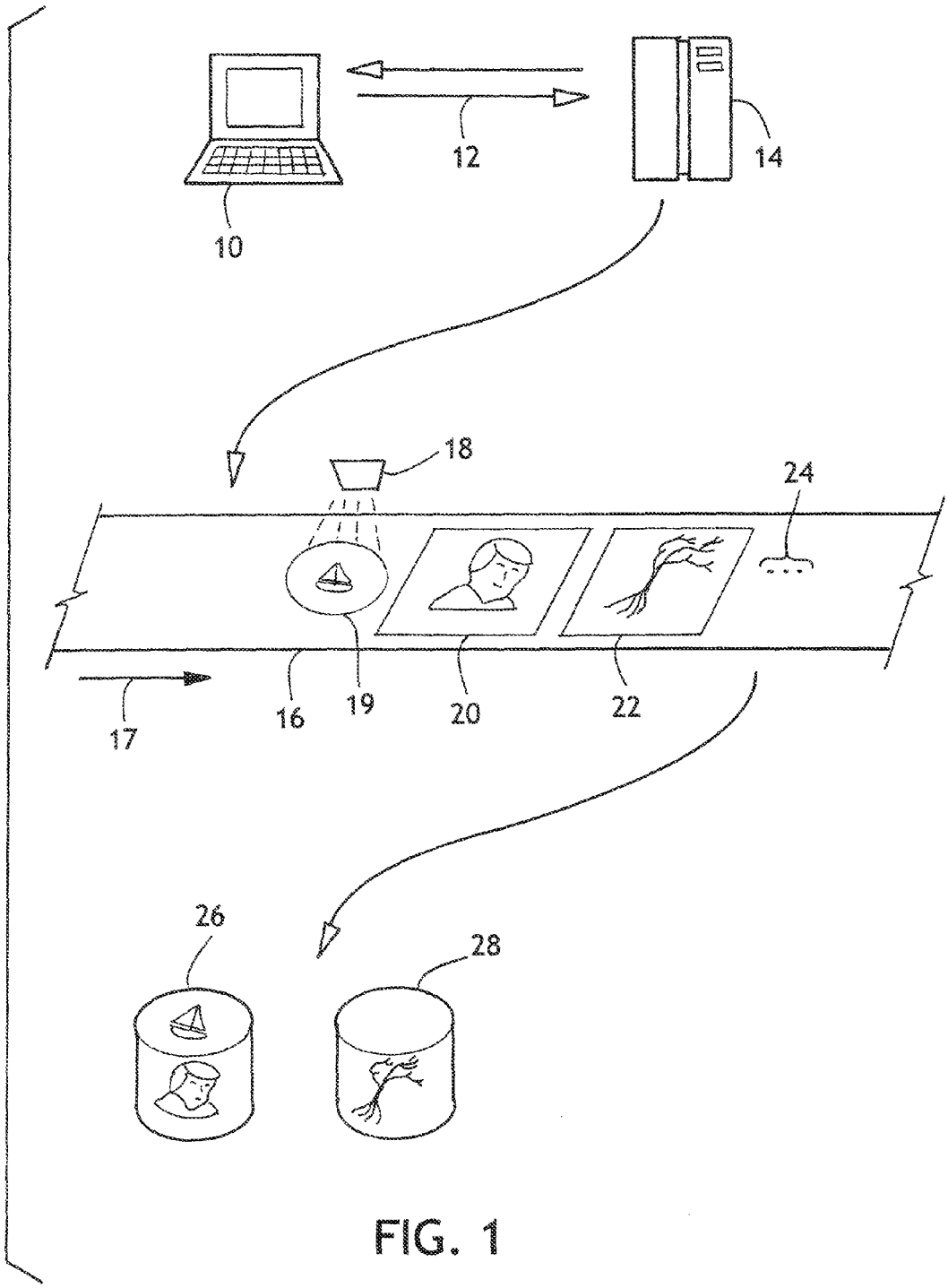

FIG. 1 shows, in simplified form, aspects of one representative version of the inventive method for making a personalized container, such as an urn for containing the ashes of a deceased family member, or pet. First, in order to print a personalized panel on a moving web such as paperboard, instructions are received that configure a unit operation, such as a digital ink-jet printing operation, to dispose the personalized panel or graphic on the moving web. These instructions, typically conveyed over a communications network, can be received in several ways. In one example, as shown in FIG. 1, a user first connects his or her personal computer 10 or other electronic device (e.g., a portable device such as a mobile telephone) to a network, whether a local-area network (e.g., a network of computers or devices configured to communicate with one another in an office), a wide-area network, the Internet, or other such network. The connection may be through a wire, wirelessly, or completed in some other manner in which information, in analog and/or digital form, is transmitted from one device to another. In any event, the personal computer 10 achieves a connection 12 to another device connected to the communications network, typically another computer 14. It should be noted that the connection 12 can include a number of different pieces of hardware (not depicted), such as additional computers, especially if the connection 12 is to, or part of, a larger network such as the Internet. Note too that FIG. 1 depicts the connection with two arrows, one from computer or device 12 to computer or device 14; and one from computer or device 14 to computer or device 12. These opposing arrows represent the connection as facilitating interactive communications between these computers or devices.

Once a connection is achieved the personal computer 10 is able to interactively communicate with the computer 14. Often this connection will be over the Internet, with the personal computer 10 denominated, for example, as a web client (or client), and the computer 14 denominated, for example, as the web server (or server). If this is the case, then the server 14 typically provides Web pages, forms, and other content over the connection 12 so that this content may be viewed and interacted with by the client 10.

A customer, then, makes various design selections for the desired personalized container, such as an urn, using the personal computer, or web client, 10. So, for example, the customer can select design parameters that include, but are not limited to: the shape of the container; the size of the container; the number of containers (e.g., if the ashes of the deceased are to be distributed among multiple survivors; or to be sprinkled in multiple locations by multiple survivors; or other uses in which the ashes of the deceased are distributed among a plurality of containers); the color of the container, including, for example, a background color (i.e., a color that predominates when viewing the container); clip art; the design of borders or other ornamentation; graphic or other themes, including, for example, themes that depict or evoke the desert, the sea, the forest, pastoral settings, waterfalls, streams, flowers, licensed copyrighted works, religious symbols, agricultural settings, metropolitan settings, motorized vehicles (e.g., trains, cars, motorcycles), sailing ships, lighthouses, gardens, planes, jets, islands, and numerous other such depictions; text, both in content and style; and other such variables. The customer can make these selections by clicking on a button, keying in text, scanning in and uploading an image in a selected file format (e.g., portable document format, or .pdf, originally created by Adobe Systems, Inc., or any other format by which the computer or device 14 may process the file so that the personalized container incorporates the design selections embodied in the file, such as the picture of a loved one; or text reflecting a heartfelt sentiment; and the like), or other such ways by which information or content may be inputted to a computer or portable device and transmitted over a network connection to another computer or device. In creating and designing the personalized container, a customer is able to choose and bring together design elements that make the container unique, and therefore one that uniquely reflects the person or pet that has passed on (for those cases where the personalized container is an urn).

Depending on the shape of the container, a customer can have the ability to design multiple panels for incorporation into a single personalized container. As discussed above, a container having a curvilinear side (e.g., a cylinder or volume having an ellipsoidal cross-section) may have personalized panels on the front and/or back portions of the curvilinear side. Furthermore, the top and/or bottom portions of the cylinder or ellipsoidal-shaped container may have personalized graphics disposed on them. Or, in the case of a parallelepiped-shaped container, a personalized panel may be disposed on each of the six sides on the outside of the container. It should be apparent, then, that different container shapes can give the customer the opportunity to design and create multiple personalized panels, one on each available viewable surface (or, in the case of surfaces inside the container, perhaps not viewable after the placement of ashes and/or memorabilia inside the container). Of course this is not required. For example, a customer might create personalized panels for the front and back of a cylindrical-shaped container, and then choose standard top and bottom portions for the container (or choose from a menu of standard options for the top and bottom portion of the container).

Also, the server 14 may transmit information content corresponding to frequently-asked questions, tutorials, help or technical assistance, or the like to assist the customer in their design of a personalized container. In some representative versions, the server may transmit examples of completed containers for viewing by the customer. Furthermore, one or more such transmitted examples may serve as starting points for the customer to modify further as they design their own personalized container.

It should be noted that the actions of a customer, and his or her interactions with the computer or server 14, are provided as context necessary to understand representative versions of the invention. Specifically, this description provides context helpful to understand the nature of what is typically the first step of the inventive process: receiving a signal, content, or instructions that specify the design elements—design elements selected by a user/customer—of a personalized container, including a personalized panel, or panels, to be disposed on that container.

Note, too, that the customer may use a number of different kinds of devices including, for example, a computer, personal digital assistant, mobile phone, mall kiosk comprising an interactive electronic device, multi-function portable device (e.g., in current parlance, a "smart" phone), or other such device that includes the hardware and software that allows for different functions, including, for example, the input, storage, processing, reception, transmission, and display of information. Similarly, the device to which signals, content, or instructions specifying the personalized panel or graphic and other design elements of the personalized container are transmitted, and received, may take on exemplary forms like those identified for the web client. Typically, however, the receiving device 14 will be a more sophisticated higher-speed computer or series of computers capable of handling many orders, including, for example, orders from people all over the globe.

In a preferred version of the inventive process, the server receives a signal, content, or instructions that specify the personalized container, including personalized panels to be disposed thereon. The server, then, generates and transmits an image of the personalized container for display on the customer's device. In this way, the customer is able to view the container he or she is designing, and prior to ordering. Furthermore, the customer is able, if desired, to see iterations of the personalized container that is being designed.

Figure 2:
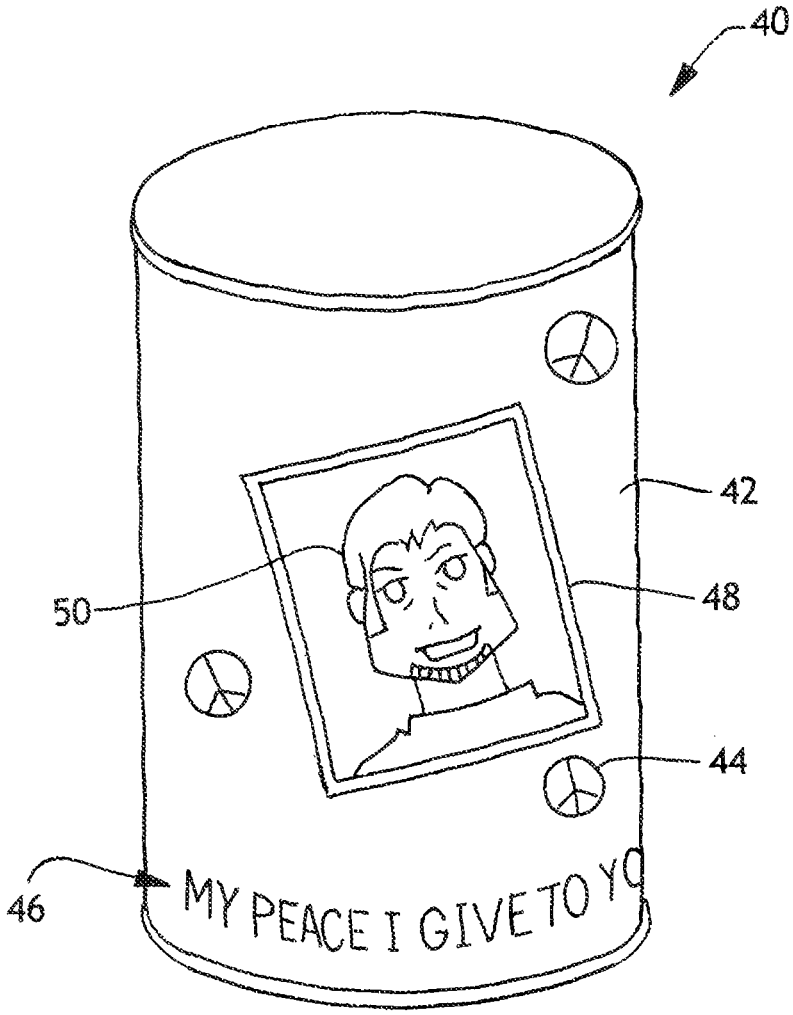
FIG. 2 shows a representative version of a personalized container.

For example, FIG. 2 shows a representative version of a personalized container 40 to be displayed, and made, using one embodiment of the invention. After selecting the shape, in this case a cylinder, and size (not shown) of the container; the background color 42; a theme or symbol 44, which in this case is the peace symbol (which corresponds to the semaphoric symbols representing "N" and "D," an initialization for "Nuclear Disarmament"); text such as a verse from a poem or scripture 46 (which, in this case, is from the New Testament, and corresponds to Jesus' statement "My peace I give to you . . . ", which is not shown in its entirety in the figure, because the letter "u" of the word "You" is not seen from the perspective shown in FIG. 2); a frame design 48 to be disposed on the container and around an uploaded image, in this case an image of the deceased; and a digitized image of the deceased 50, which is positioned within the frame design 48. In this case the top most portion of the container does not show a personalized panel. But, as discussed elsewhere, representative versions of the invention encompass received instructions specifying more than one personalized panel to be disposed on the container.

Figure 3:
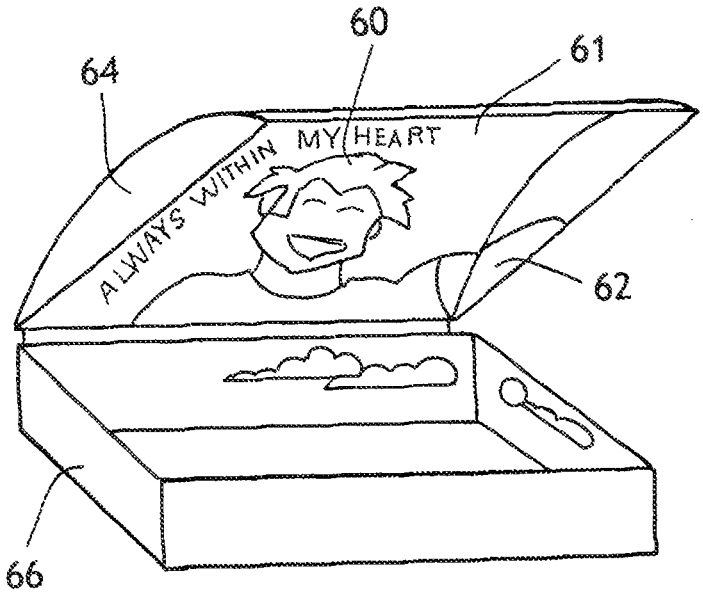
FIG. 3 shows a representative version of a personalized container.

FIG. 3 shows another representative example of a personalized container. In this case a personalized panel is disposed on the interior of the open container. The personalized panel includes a depiction of a person 60, now absent. Furthermore, a sentiment displayed in the text "Always Within My Heart" 61 appears around the person 60. In this particular version, the person's arm 62 is disposed on an interior surface that is adjacent to, but substantially perpendicular with, the surface on which the image of person 60 is disposed. This then demonstrates an advantage of some versions of the invention. If the personalized panel is disposed on a web prior to converting the web into a personalized container, then the personalized panel may assume complex contours inside and outside the container. So, for example, if the personalized panel is first digitally printed on a substantially flat paperboard web, and the printed paperboard web is then folded or otherwise manipulated to assume various surface contours, the personalized panel appears on those surface contours. If, instead, the personalized container is formed first, and the personalized panel is then disposed on the already-formed container, it may be more difficult to have the personalized panel follow, and attach to, complex contours, especially those contours or surface on the inside of a container (e.g., applying a personalized panel to a finished container like that depicted in FIG. 3, with the personalized panel disposed on two surfaces that are substantially at a right angle to one another). Depending on the size of the container depicted in FIG. 3, it may serve as a temporary coffin (assuming it is of a size sufficient to accommodate the remains of a deceased entity, whether an adult person, a child, or a pet); a keepsake container (assuming it is of a size sufficient to contain memorabilia); or a box that helps trigger remembrances of a person who is absent (with possible cues for triggering such remembrances being the visual image or other visual cue; a sound chip that stores and plays the voice of the person being remembered; a scent enjoyed by, or reminiscent of, the person who is absent; a texture of a fabric, natural element [e.g., plant, stone, etc.], or other material enjoyed by the one absent, and/or other sensory cues). In this representative embodiment, a lid 64 is attached to the main body 66 of the container. Furthermore, clouds and the sun appear on a personalized panel as a back panel disposed on the interior of the main body of the container that then has secondary elements added to further personalize the panel such as the interior exposed cover of a casket when set up for the viewing of the deceased person or pet. In some representative versions of the invention, FIG. 3, sized to accommodate a human body, may have disposed thereon an image of the American flag (inside the container, outside the container, or both). A personalized panel, such as an image of a person (e.g., that of a soldier), may then be disposed inside the container, outside the container, or both, with the personalized panel on either a web used to form the personalized container, or a cut sheet attached to the container.

Figure 3A:
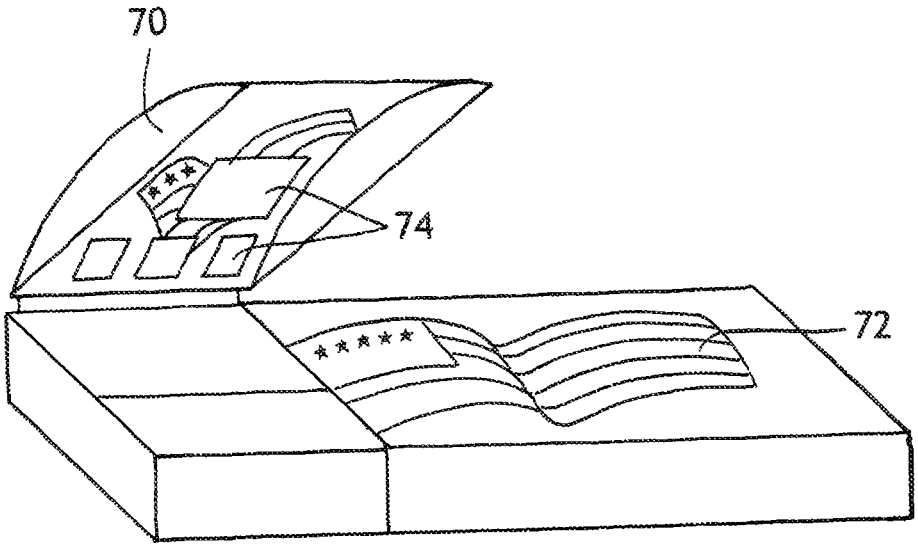
FIG. 3A shows a representative version of a personalized container.

FIG. 3A depicts one version of a personalized container, in this case a temporary coffin having a lid 70 that opens at a location permitting the viewing of the upper body and/or face of a deceased person, but not the lower portion of the deceased person's body. In this case a flag 72 is printed on the outside, upper surface of the temporary coffin. The image of a flag, or other images or text, may be disposed on the inside or outside of the temporary coffin by digital printing, offset printing, engraving (e.g., laser engraving or etching), or the like. As noted elsewhere, a number of personalized containers may be made in which the containers have some common elements, such as the depiction of a flag in FIG. 3A. In this representative version, several personalized panels 74 are disposed on the inner surface of the raised lid 70. Received instructions specify the personalized panel disposed at each of these locations, which may include a picture of a loved one, other images from the person's life, a heartfelt sentiment, or other such custom designs. These personalized panels may be disposed on a web that is converted into the temporary coffin (alone or with other components). Or the personalized panels may be disposed on cut sheets and attached to the temporary coffin.

Figure 4:
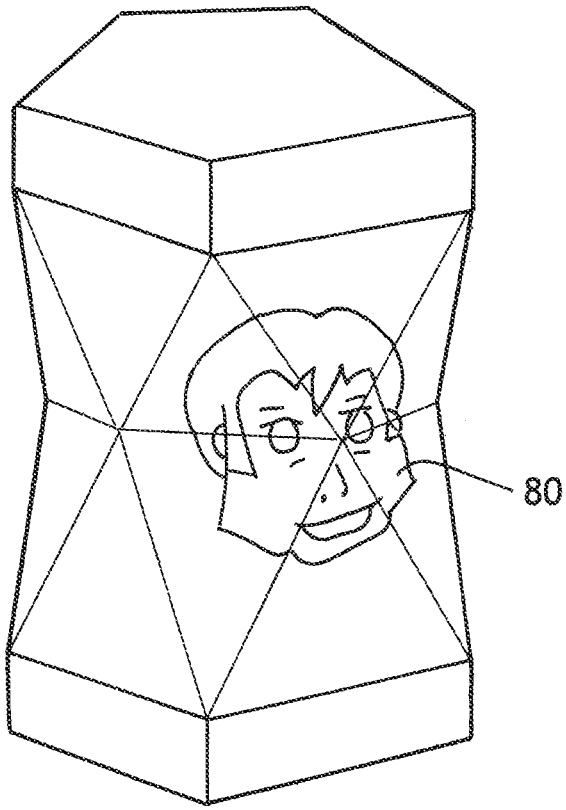
FIG. 4 shows a representative version of a personalized container.

FIG. 4 shows another representative embodiment of a personalized container. In this case a personalized panel comprise a person's face 80. Here the web (e.g., paperboard, or a film) is folded to present a polygonal appearance on the surface of the container. As noted above, representative versions of the invention in which a personalized panel is disposed on a web, with the web bearing the personalized panel then being converted into the finished container, may allow for the personalized panel to appear on, and follow, more complex surface contours (e.g., across different sides or faces of a container), both inside and outside the container.

After a customer makes these selections (including the scanning in and uploading of a digitized image, in an appropriate file format, to the web server), he or she is then able to see a visual display of the personalized container they designed. In one version of the invention, this image of the container may be rotated in one or more directions so that the customer can see the container from different vantage points. For example, a customer might position a cursor over an arrow displayed on the screen near the image of the personalized container. By clicking on the arrow, the image of the container is rotated in the direction of the arrow so that the customer can see the personalized container from a different perspective. Or, alternatively, more than one image of the personalized container may be generated after the customer has made his or her design selections, with the customer toggling between these different perspectives. Regardless of the specific approach, the customer is able to view a representation of what will be made for the customer in response to an order for the container. In effect, the representation or image of the personalized container reflects the proposition "what you see is what you get," or, as an initialization, WYSIWYG.

Representative versions of the invention encompass one or more of the following. Once the customer has looked at an image or representation of the personalized container they designed, he or she may delete all changes and start from scratch. This is true whether the customer is working on one personalized panel to be disposed on the container, or multiple personalized panels. Alternatively the customer could save one panel design and then start on a second design (e.g., so that different designs may be compared before making a final choice of the personalized container to be ordered; or because the customer wishes to order two or more different personalized containers, perhaps because the ashes of the deceased are to be placed in two or more containers; or for other reasons). Or change the background color, or the panel location of a particular design. Or change the theme. Or delete the uploaded image and replace it with another uploaded image. Or dispose a second image on a different part of the personalized death-care container. Or change or add text. Or change the font and size of text. Or change one personalized panel to be disposed on the front of the container, while keeping a completed panel design for the back of the container. Or swap one personalized panel design for another (e.g., front to back and back to front). In other words, the customer is able to go through a process where he or she is able to try out numerous ways of honoring and remembering the deceased person or pet—which, as noted above, should help the survivor through the grieving process. After all, representative versions of the invention allow a survivor to put together a personalized container that is uniquely the customer's own creation—one intended to evoke pleasant memories and images of the person who has passed on while, at the same time, reflecting the uniqueness of the life of the deceased. And the resulting container is tangible and helps evoke, through the senses, the deceased person or pet.

Note, too, that the aforementioned process may be used by a person who is pre-planning for his or her own death; or who is personalizing a container for the purpose of creating a box for memorabilia to be opened at some future event (e.g., the wedding, graduation, or other milestone event of one who will survive the person's anticipated death); or who is personalizing a container that is used temporarily to contain the body of the deceased before cremation (the viewing of a body prior to cremation, and the actual witnessing of cremation, are becoming more commonplace).

After a customer has designed one or more personalized containers, and, preferably, after the customer has seen one or more iterations of this design (or designs), especially the final design arrived at after a sequence of changes and which corresponds to the design which the customer wishes to order, the customer undertakes some action to confirm the final design and order the personalized death-care container (or containers). Typically this will involve the customer clicking text and/or graphics signifying that an order is being placed (e.g., by using a mouse or other pointing device to move a cursor on the screen over a button-like image having the words "Place Order", or the like, associated with or on the button); entering, usually with a keyboard, other information needed to fulfill the order (e.g., shipping address, contact information, information regarding the nature of payment, method and cost of shipping, etc.); and other such information. In representative versions of the invention, the personalized container specified by the customer, along with other entered information, results in a record corresponding to the order.

Representative versions of the process include a step in which the uploaded content, and inputted text, are reviewed prior to the manufacture of a personalized container on which the content and text are to be disposed. The content and text are reviewed to help ensure that copyrighted material is not being used without the consent of the author of the copyrighted material; and to ensure that objectionable content is not included in the design of the personalized container. Of course such a review takes time, and typically will require, at least in part, a human observer to evaluate the design, and then reject or accept the design based on previously announced guidelines (with such guidelines typically accessible to the customer through their interactions with the device 14, which, as noted above, is typically the web server for transactions over the Internet).

After the instructions for the specification of the personalized container are received and, optionally, reviewed to ensure that the instructions comport with the law, established guidelines, or both, the instructions are used to dispose one or more personalize panels on a web. Generally this means that the instructions are ultimately transmitted in the same, or different, form to a printing operation in which the instructions specify a graphic image to be printed on the web (with the graphic image corresponding to graphic elements such as text, pictures, and other elements of the personalized panel(s) designed by the customer). Thus, for example, the design elements shown in FIG. 2—a selected background color, the theme of peace symbols, text, a picture frame, and an uploaded, digitized image—are printed on a web by ink-jet printing equipment. Similarly, in FIG. 1, web 16, moving to the right of the page as signified by the arrow 17, passes under an ink-jet printing operation 18, thus disposing representative images 19, 20, and 22 on the web (again, with each image corresponding to some or all of a personalized panel designed by a customer, and therefore reflecting instructions received over a communications network). The ellipsis 24 signifies a sequence of images (not shown), each corresponding to other personalized panels. It should be noted that the lines crossing the opposing, longitudinal ends of web 16 signify that the portions of the web extending beyond these curved lines are not shown in FIG. 1. This printed web, then, is directed to other unit operations in which the web is converted into, in this case, the cylindrical, personalized urns 26 and 28 (the cylindrical urn 26 incorporates graphic images 19 and 20 on the web—with the image 19, a depiction of a sailboat, appearing on the top portion of the container, and the image 20, a depiction of the deceased, appearing on the side of the container; and the cylindrical urn 28 corresponds to the image of a wind-swept tree shown in image 22, with no personalized panel appearing on the top portion of this particular container). Note, too, that the urn depicted in FIG. 2 may be made using this representative embodiment.

A sequence of personalized panels disposed on a web may each correspond to different personalized containers. Or, two or more personalized panels may be incorporated into a single personalized container, with each personalized panel disposed on different portions of the container. Note too that different personalized panels may be disposed on different webs, which are then combined to form the corresponding personalized containers.

FIG. 1 does not depict the converting steps by which the web is processed to form the container. Typically the web is converted into a container by folding, cutting, joining, and other such conventional operations used when converting webs or substrates such as paper, paperboard, and/or films into an end use consumer product. The web may be joined to other components as part of this converting process.

The preceding paragraphs provide an overview of a representative version of the inventive process. Additional detail about this process, as well as representative embodiments of the invention, are presented below.

Representative Communication Networks and Associated Interactions

As noted above, the inventive process includes a step in which information or instructions are received over a communication network, with this information or instructions specifying a personalized panel, and other design parameters, for a personalized container, such as an urn.

Typically a customer will use a personal multi-purpose computer at his or her home when designing a personalized container. But the customer can use other devices, at other locations, to design the container. For example, the customer might use a portable computer and access the Internet at a public location (e.g., a coffee shop, Internet café, library, etc.), often using a wireless connection (e.g., using the Wi-Fi protocol). Or the customer could use a publicly available computer, located, for example, at a library, or school, to design the container.

Alternatively, a customer could use a computer or other device located at a kiosk (e.g., at a shopping mall), store or other establishment in a shopping mall, a funeral home, or other location. For example, a customer might, at a funeral home or cremation facility, use a computer or other device to design a customized urn, perhaps with the assistance of an employee of the funeral home or cremation facility. Note, too, that the computer or other device may transmit information, via a communications network, to another device, such as a web server, as part of the process by which the personalized container is designed. In effect, here, as for other such embodiments described herein, the majority of the software instructions by which the personalized container is designed reside on a web or network server with which the device used by the customer interacts. In some versions of the invention, however, the software employed to facilitate design of the personalized container resides on the same device used by the customer.

So, for example, the software specifying the graphical interface by which a customer makes design selections, and then sees the visual display of the corresponding personalized container, may reside on the same computer used by a customer to input his or her design selections (rather than transmit these selections/instructions, over a network, to a separate computer, such as a web server). Ultimately, of course, the instructions specifying the personalized design must be relayed to the unit operations by which the personalized container is made. Thus, in one version of the invention, a customer would use software residing on the computer being used by the customer to design a personalized container. Once the design was finalized, these instructions would then be transmitted to a separate computer, or a plurality of computers, for any further processing necessary to dispose the personalized panel on a web that is converted into the container or a portion of the container. For example, the personalized container depicted in FIG. 3 can, if made large enough to accommodate a human body, serve as a temporary coffin. If instead the container is made smaller, then it could serve as a keepsake container for memorabilia; or, alone or in combination with other sensory cues (e.g., a recording of the voice of a loved one; a scent favored by, or reminiscent of, the loved one), serve to help trigger remembrances of that person. In any of these cases, a personalized panel is disposed on the interior of the container.

A customer will generally make design selections using input hardware and software including, but not limited to, keyboards, point-and-click devices such as a mouse, voice-recognition devices, touch screens operated using a stylus or finger, scanners to scan in documents, and other such hardware by which a customer is able to input selections, information, or content.

Regardless of the hardware and software configurations that are used, information is transmitted by wire, or wirelessly, over one or more communications networks. If desired, the security of transmissions implicated by the design and ordering of personalized containers may be increased using hardware or software including, for example, techniques for encrypting information; techniques for authenticating the identity or source of a communication; and the like. Furthermore, the customer may be given some choices as to whether, and to what extent, others may have access to a computer record or account corresponding to a particular design or order. For example, a survivor might initiate, or complete, an order for a personalized urn to be used to contain a portion of the ashes of a loved one. Other survivors might be given access to the record or account corresponding to this order so that they, too, could design separate urns (perhaps after viewing the design done by the first survivor), or by adding or switching out other design elements to the design initiated by the first survivor. Note, too, that the software specifying the graphical user interface and other architecture by which the customer designs and orders a personalized container can transmit prompts recommending the appropriate urn size depending on whether the ashes of the deceased are placed in one, or more than one, personalized containers.

In another embodiment, someone anticipating death due to a terminal illness might design a plurality of personalized containers, one for each survivor. These containers might be used to contain ashes of the deceased, memorabilia associated with the deceased, or both. The requestor of these containers could choose to include some of the same design elements in all of the containers, and then, for each survivor, include some unique design elements. So, for example, the requestor might include his or her own picture on all of the requested containers, this then being one of the common design elements, with this picture forming part of one personalized panel (e.g., a personalized panel appearing on an outer surface, such as the outer surface of a lid of a personalized container like that depicted in FIG. 3). The requestor might then include a picture of the survivor on a second personalized panel disposed on an interior surface of the personalized container, with this particular personalized panel appearing only on the container to be received by the depicted survivor, this then being a unique design element for each container. Furthermore, as described elsewhere, a sound chip may be selected for incorporation into each of the containers. The person requesting the containers could include a unique, recorded message, from the requestor, to each of the survivors. Because this personalized container serves to trigger remembrances of the one absent through one or more sensory queues, it is denominated as a Remember-Me-Always™ Keepsake box.

The manner by which a customer designs and orders an urn will typically mean that an account or record is created. The record will include personal information necessary or helpful to fulfilling an order, including, for example, the person's name, shipping address, payment information, and the like. The information stored in a particular record will depend on the particular end-use of the personalized container. If the person designing the container is doing so for himself or herself, then the record might not contain information about others, or inputted by others. But it could. For example, a person who is pre-planning for his or her own death may ask friends or family to help design a personalized container (e.g., an urn). If so, the person doing the pre-planning may ask other individuals to input design selections, generally by giving selected persons access to his or her own account (e.g., by providing selected people with a password that grants access to the account) so that one or more friends or family members could, from locations or devices different from the pre-planner's own location (and computer), input design selections. The design could be finalized before death; or initiated before death of the loved one, and finalized after death. Similarly, if the person who is pre-planning for his or her own death is designing a container for memorabilia, e.g., to be opened at some future milestone event of a survivor, such as a wedding, that will likely occur after the pre-planner's death, then the person doing the pre-planning may design the container on his or her own, or, as described in the previous embodiment, authorize one or more other individuals to input design selections or content (e.g., from other computers at other locations). Note, too, that the specifications for a given personalized container may be kept on file for some period of time, thus providing the opportunity for receipt and processing of additional orders of the personalized container (beyond the quantity that was initially ordered).

In another representative embodiment, survivors may, as described above, alone or together, design one or more personalized containers to be used to contain the ashes or memorabilia of the deceased.

In some versions of the invention, personalized panels, or elements thereof, may be disposed on other items associated with an end-of-life ceremony. For example, a personalized panel appearing on an urn may also be printed on a poster appearing at an end of life ceremony; or on announcements or programs associated with the ceremony; or other such printed publications.

Representative versions of the invention, as described in the preceding paragraphs and elsewhere in the application, include a step in which instructions specifying the design of a personalized container are received. These instructions are used to produce visual displays of the personalized container designed by the requestor. The visual display is transmitted to the requestor's device for viewing, thereby enabling the requestor to see what he or she has designed before ordering (and, preferably, as part of an iterative design process). Once finalized, and an order made, the received instructions are used to specify and make the personalized container ordered by the customer. It should be understood that numerous hardware and software configurations may be employed in the inventive process, so long as a customer is able to design and order a highly customized container, preferably after seeing one or more visual panels composed of images and the like of the container that is being designed.

Representative Design Elements of a Personalized Container

As generally described elsewhere, users of representative embodiments of the invention may make a number of design selections when designing a personalized container. And these design selections are received, in the form of signals, instructions, or information, over a communications network. This then means that the information is typically received in some readable form (i.e., readable and capable of being processed further by the device receiving the information, such as a web server). The received information, which corresponds to design selections made by users (and potential or actual customers), relate to a number of different design variables for the personalized container.

First, the received information may include a design selection corresponding to the size of the container. As noted elsewhere, a person pre-planning for his or her own death, or one or more survivors who are personalizing a container, may elect to permanently or temporarily store the deceased's ashes in one container, or two or more containers (here the personalized container is an urn). Depending on the number of containers into which the deceased's ashes will be placed, different urns sizes may be chosen. Furthermore, and as noted elsewhere, a user's responses to prompts or questions guiding a user's design selections—with these prompts or questions transmitted from, for example, the web server—can result in the transmission of recommendations to the user, here a recommendation as to a container size the user can choose depending on the intended end use. Thus a couple, preplanning for their own deaths, may elect to ultimately have their ashes stored in one container (a transmitted recommendation, then, would suggest a container size capable of holding the ashes of two adults).

Second, the received information may include a design selection corresponding to the shape of the container. The shape of a container can be a cylinder (i.e., the side wall of the container defines a volume having a circle-shaped perimeter), a cube, a wedge-shaped container, a container with a sidewall that defines an ellipse, a polyhedral-shaped container, a parallelepiped, or other such shape. It should be noted that, generally, providing increased design flexibility may result in increased manufacturing costs. For example, the unit operations needed to further process a web on which is disposed a personalized panel may be different, or may need different operating settings, depending on the container's shape, the container's size, or the material with which the container is made. Accordingly, the more shapes that are offered, the more cost (variable, fixed, or both) is likely needed. Thus some embodiments of the invention may limit the shape, size, or both of the personalized container. Alternatively, some versions of the invention may include more than one manufacturing line for making personalized containers. For example, one manufacturing line may be dedicated to making a certain size and shape of a container. In this way certain costs associated with grade or product changes on the same line are avoided (e.g., set up time to change machine settings). That which needs to be highly customizable on each line, the personalized panel (i.e., the combination of graphic elements such as text, images, and other ornamental features), is typically achieved, as stated elsewhere, using a digital operation, such as a digital ink-jet printing operation. The operation by which personalized panels are disposed on a web may be in-line with each of the manufacturing operations used to convert the web, with or without other components, into a personalized container. Alternatively, a web, or in certain circumstances, cut sheets, may be printed off-line from other unit operations used to convert the web, or cut sheet, into a container. As is described in more detail below, the web or cut sheets may be processed to dispose personalized panels thereon. The web or cut sheets with said personalized panels could then be moved or directed to one or more separate, manufacturing lines by which the web or cut sheets are then converted into personalized containers of various sizes and shapes.

In one version of the invention, one step of the process involves employing received instructions to dispose personalized panels on a web or cut sheets. Each of these personalized panels corresponds to one of three container sizes: small, medium, or large, the converting operations for which constitute three separate lines, one for each size. The web or cut sheets on which the personalized panels are disposed are processed further so that each personalized panel is directed to the correct converting operation (i.e., the web or cut sheet bearing a given graphic composed of text, images, and other ornamental features is then converted into the container size selected by the customer who designed the personalized panel). One manner by which this is done is to sort the electronic records corresponding to the orders so that a sequence of personalized panels on a web, or on cut sheets, all correspond to one size, with the resulting web, or cut sheets, then being directing to that converting operation configured to make personalized containers of that size. This can be done by having a field in the record that corresponds to the selection of a container size, with the information in this field then being used to sort the records for this purpose.

In some versions of the invention, the design of the container may be such that the personalized panel is the same size regardless of the container size on which the panel is disposed. Alternatively the personalized panel is sized differently depending on the size of the container on which the panel is disposed (e.g., a larger personalized panel is disposed on a larger container).

Note too that the recited examples of container shapes may reflect a rigid or semi-rigid container (e.g., akin to paperboard packages used to contain various consumer products or foodstuffs, such as cereal, oatmeal, facial tissue, frozen food, etc.). Or the shapes may correspond to a more flexible container (e.g., akin to paper or film bags used to contain snack foods). Also, some personalized containers may be made by disposing a personalized panel on a web, and then marrying, or joining, the web to other substrates or materials (e.g., a more rigid substrate) when converting the web with the personalized panel into a personalized container. As noted elsewhere, in some versions of the invention the selected materials by which the personalized container is made are biodegradable.

Thus, for example, a paperboard substrate may serve as the web on which is disposed, e.g., by printing, a personalized panel designed by a user, and therefore corresponding to received instructions (e.g., information transmitted over a communications network and received by a web server). This printed paperboard substrate may then be cut and joined to another substrate as part of the process by which the web bearing the personalized panel is converted into a personalized container. So, for example, the portion of the web bearing the printed panel might first be separated from the remaining portion of the web (e.g., but cutting or slicing). The separated web portion bearing the personalized panel can then be attached (e.g., by gluing with an adhesive or held in place by a transparent overwrap) to a cylindrical cardboard tube, or other shape or material. If, as described in this example, the personalized container is a cylindrical tube, then plastic or paperboard top and bottom portions are attached to form an enclosed volume. These top and bottom portions have a diameter such that they fit the cylindrical tube in some manner. For example, these top and bottom portions may be sized such that some part of the top and bottom portions fit inside the cylindrical tube, outside the tube, or both, so long as there is a secure fit between tube and these top and bottom portions ("secure" meaning that these end portions will not readily separate from the tube). A secure fit may be achieved through friction, through attachment (e.g., an adhesive bond between one or both end portions and the tube); an ultrasonic bond between one or both end portions and the tube (or using some other form of energy input by which the materials are joined or fused); a mechanical attachment, as with threads, hinges, or the like; or other conventional manner of attachment.

Because the interior of the container must be accessible so that, for example, ashes or memorabilia can be placed in the container, the finished container, and the manner of making it, will include incorporating into the container one or more openings. Thus, in the embodiment described above, the bottom portion may be attached or joined to the cylindrical tube so that it cannot be removed without extraordinary force (e.g., the bottom portion can be adhesively bonded to the tube). The top portion, then, can be attached in a way that it is releasably engaged to the tube (as with a mechanical manner of attachment such as threading, or using a hinge or hinges). Or the top portion may include one or more openings itself, and therefore be joined to the cylindrical tube in a manner similar to the bottom portion. Alternatively, the top and bottom portions of the container may be injection-molded plastic components that are fitted to the upper and lower openings defined by the cylindrical (or other shaped) container.

In addition to design elements like those described above, a user can select various design parameters relating to the personalized panel itself (with the panel comprising various graphic elements as described elsewhere). In one representative embodiment, ink jet printing is used to dispose the personalized panel on a moving web. Thus the received instructions or signal specify a number of parameters that determine the appearance of this panel including, for example, one or more of the following graphic elements: a background color (meaning an overall color that a viewer perceives when looking at the container); one or more frames in which may be displayed images or text—or the absence of such frames, with the images or text appearing directly on any background color, with or without an ornamental theme; the style, size, orientation, and color of the frame (if any); clip art; ornamental themes, whether natural or abstract (natural themes may include a number of images, including the kinds of images used as the wallpaper or background on the desktop display of a personal computer such as, for example, black-and-white photographs akin to those taken by Ansel Adams; images of various environments and natural phenomena, such as the beach, the rain forest, snow-capped mountains, lakes, rain drops, snow flakes, the ocean, trees, farms, cityscapes, and the like; images of space such as Jupiter, Saturn, nebula, galaxies, and the like; abstract paintings akin to the geometric blocks of color painted by Rothko, or similar to the paint-splattered canvases of Jackson Pollack) or designs typically used on apparel including herring bone, plaids, polka dots, and the like; for any displayed text, the font size, color, and type (e.g., Futura, Courier, Times New Roman, etc.); logos of schools; military symbols; religious symbols; numerous other design elements that may be disposed on a web, typically by ink jet printing; and combinations thereof.

In representative versions of the invention, the design of the personalized panel maybe somewhat similar to the design of the appearance of a Web page; or the use of desktop drawing, illustrating, or publishing programs; or the use of software to design presentations (e.g., Microsoft's PowerPoint-brand presentation software; or Apple's Keynote-brand presentation software). In all of these cases, an intuitive graphical user interface facilitates the design and arrangement of text, images, and other ornamental features to produce aesthetically pleasing images. Making use of point-and-click devices to manipulate an on-screen cursor, a keyboard, and other input devices (e.g., voice-recognition hardware and software; a stylus to manipulate on-screen objects; a stylus or other device to trace or draw lines on a grid or board, with the lines, then, displayed on screen; devices for scanning documents and uploading the corresponding digital file corresponding to the scanned document; etc.), a user is able to input (and import) information, and further manipulate it (e.g., by moving objects or text on-screen to new locations; editing text; changing color of various on-screen objects or text; re-sizing objects; adding clip art; etc.) to arrive at the desired personalized graphic.

Any hardware and software combination may be used to facilitate the design process, so long as, in representative versions of the invention, instructions corresponding to a personalized or customized panel to be disposed on a personalized container are received and available for further processing necessary to display the container for viewing by the customer, and to make the corresponding personalized container.

Additional Detail on Representative Methods of Making a Personalized Container

Before the container can be made, various materials for making the container must be selected. As noted above, some versions of the present invention employ unit operations in which a web is continuously conveyed through the process (at least it is continuously conveyed until the web is separated into individual web portions, typically with each web portion comprising a personalized graphic panel that corresponds to instructions received over a communications network, with the individual web portions then being converted into individual personalized containers), which allows for the possibility of a higher-speed manufacturing operation, with more personalized containers being made per unit time, compared to existing ways by which, for example, urns are typically ordered (e.g., from a hard-copy or electronic catalogue of offerings).

If, for example, a paperboard or film substrate is used as the web, and an ink jet printing operation is used to dispose the personalized panel on the web, then the web can be run through the process at linear speeds of 100 feet per minute to 2000 feet per minute; 200 feet per minute to 1000 feet per minute; 300 feet per minute to 600 feet per minute; and other such speeds that may be achieved with higher speed, commercial quality, ink jet printing operations. Such operations allow for uniquely customizable graphics back to back, or inches apart from one another, without the need to make printing plates (as is needed for impact printing operations, such as offset printing operations), or the set up time needed to employ such plates. To achieve the resolutions necessary to effect higher quality text and graphic images, the printing operation will typically produce images having photographic-quality images; e.g., between about 600 dots per inch to 2000 dots per inch. If, however, lower resolutions are acceptable, then lower numbers of dots per inch may be used. Similarly, to achieve higher resolution, the droplet volume will generally be between about 3 picoliters and 30 picoliters. Smaller volumes and drop sizes generally provide for higher resolution. Again, however, larger droplet volumes (and sizes) are acceptable if lower graphic resolutions are acceptable.

In some versions of the invention, the web that is printed is selected to optimize or improve the printing of the graphic. For example, if ink jet printing is used to dispose a graphic on the web, then a substrate is selected that allows for high-speed ink jet printing of higher quality images. This substrate, then, is converted into a personalized container in subsequent unit operations (e.g., attaching the web portion bearing the printed, personalized panel to other components when making the container).

Paper or paperboard webs may be made using a number of different fiber types and processes. For example, softwood or hardwood fibers, or blends thereof, may be employed. Such fibers may be obtained from corresponding wood sources using different kinds of pulping operations (i.e., the process by which individual wood fibers are liberated from wood), including, for example, chemical, mechanical, or chemi-mechanical operations. Also, recycled fiber may be obtained and used. Because wood represents a renewable resource, the use of paper and paperboard webs offers, for many customers, a desirable choice of a so-called "green", or biodegradable option.

Depending on the end use of the personalized container, one or more additives or ingredients may be incorporated into the web bearing the graphic, or other components to which the web is attached. For example, paper or paperboard substrates may include wet-strength agents that, as their name implies, gives the substrate strength and integrity even when wet. Furthermore, for the web on which the personalized panel is disposed (or for other webs used to make the container), additives or coatings may be applied to the web to improve its receptivity to ink; to minimize migration of the ink once it is on the surface of the web; and to reduce or eliminate smearing (if ink jet printing is the way by which the personalized graphic panel is imparted to the substrate). Note, too, that the web on which the personalized panel is disposed can be treated with energy to increase its receptivity of ink (e.g., the web may be corona treated—i.e., passed through an electric corona—to alter the surface characteristics of the web). For death-care containers, such as urns, that are intended to be placed, intact, in the ground, materials may be selected so that the container is able to break down more readily in the environment (whether physically, chemically, or both).

For some embodiments (e.g., an urn used to store the ashes of the deceased—perhaps in a survivor's home—rather than hold ashes temporarily), materials may be selected that help reduce the susceptibility of the graphic to photo-degradation (i.e., the process by which various wavelengths of light—typically in combination with exposure of the colorant to oxygen, water, or both—alter the ink chemistry such that the colors fade or change in appearance—again, if ink jet printing is used to dispose the graphic on the web). This may be done by selecting ink chemistries that are less susceptible to photo-degradation. Alternatively, or in addition to selecting ink chemistries to reduce this problem, films may be selected that help filter those wavelengths of light that are more likely to degrade the ink materials. Also, the paper or paperboard substrate may be coated in a way that the light fastness of the color is increased (i.e. is made less susceptible to photodegradation by helping shield the deposited color from oxygen, light such as ultraviolet light, water, or some combination thereof; by increasing the degree of attachment of color-producing molecules to the substrate—e.g., by increasing the number of hydroxyl or carboxylic-acid functional groups present when the colorant is cationic, or positively charged; or both).

Note, too, that materials may be selected that act as a barrier to water or water vapor. So, for example, a plastic film or copolymer blend may be used when constructing the personalized container. Of course the use of conventional films will likely mean that the resulting container is less likely to physically or chemically degrade in the environment, except after significantly long periods of time. This will generally not be perceived as a problem for containers that are intended to be kept, rather than used temporarily.

If a personalized panel is disposed on a film, then the film may be used to wrap around a paperboard container, an injection-molded plastic container, or other object. Note too the film may be heat-shrinkable. By applying heat the film shrinks, thereby helping the film conform and/or attach to the underlying substrate. In some versions of the invention, the film incorporates an adhesive or other material (e.g., a film decal) that helps the film adhere to, or fuse with, the underlying substrate. E.g, a personalized panel may be disposed on a film decal which is then inserted into an injection mold so that the plastic container or object formed by the mold includes the personalized panel disposed on the film decal, with the film decal attached to the injection-molded container.

Representative embodiments include the step of receiving instructions, in some analog or digital form (or both), specifying design elements of a personalized container, including, for example, a personalized panel to be disposed on the container. Typically, as noted elsewhere, a web, such as paperboard or film, is run continuously through the process by which a personalized panel is disposed on the surface of the web. In some circumstances, however, a cut sheet process may be used to print the personalized panel, with the sheet bearing the panel then being married to other components to form the personalized container. For example, a cut sheet, high-speed, ink jet printing process may be used to sequentially print personalized panels on the cut sheets, with each personalized panel corresponding to received instructions transmitted over a communications network. These cut sheets are then attached to other components to make the personalized container. For example, each individual sheet bearing a panel may be adhesively attached to a paperboard cylinder. After the sheet is attached to the cylinder, a film may be wrapped around the combination of the cut sheet and underlying paperboard substrate. If the film is shrinkable, then energy, perhaps in the form of heat energy, may be used to shrink the film around the underlying combination. Finally top and bottom portions may be attached to complete the personalized container.

For many representative versions of the process, one or more webs are unwound continuously from an unwind stand. As the web is unwound, it is directed along its path by conventional methods for conveying film, paperboard, paper, or other webs. For example, the web may be directed over a roll, or between two rolls (e.g., through the nip between two rolls), that are rotating in a way that velocity is imparted to the web so that it travels along its path. Suction boxes may be employed to help reduce flutter or ensure that the web is directed appropriately. That is, the suction boxes create sufficient vacuum to help hold the continuously moving web on or near the suction box (e.g., with a suction box positioned in a rotating roll so that the web travels along some portion of the surface of the roll). Furthermore, the velocity of various rolls can be selected so that the tension of the web is appropriate.

After the web is unwound from its reel, it is directed to a unit operation by which personalized panels are disposed on the web. A preferred way by which a personalized panel may be disposed on a web over a range of speeds, including higher speeds of larger-scale operations, and over a range of qualities, including higher qualities (e.g., higher resolution), is ink jet printing. Ink jet printing provides the opportunity to impart different, highly customized, graphic images, in sequence along a travelling web. This is so, at least in part, because plates for printing the image need not be made. And the set up time needed to change plates is avoided. Instead the instructions for a personalized image, in digital form, are processed by computers so that the ink-jet equipment deposits droplets of ink (typically the colors black, magenta, cyan, and yellow; with these colors then overlying one another to produce a range of colors and hues) in the appropriate location on the moving web. A queue of sets of printing instructions, with each set corresponding to the personalized panel created by a customer, are processed so that each set of instructions specifies operation of the ink jet equipment to produce the desired personalized panel on the web.

It should be noted, however, that ink jet printing, or other such methods that allow for high customization (e.g., digital offset printing) may be used in combination with lithographic, rotogravure, photogravure, or other offset printing methods. For example, an offset printing process might be used to print a basic theme, or color, or background objects on a substrate. This offset printed substrate could then be used as the web on which are disposed elements of the personalized panel selected by a user. Furthermore, the off set printing process may be used to impart additives or coatings to the substrate prior to its being printed with other elements of the personalized graphic (e.g., the substrate may be coated so that color fastness and light fastness is improved—i.e., the colorants are less susceptible to smearing, photo-degradation, or both). If an offset printing process, or other impact process relying on plates for printing, is employed, it may be used either in-line with the ink jet, digital offset, or other printing operation used to dispose highly customizable elements of a personalized graphic on the web. If such an offset printing process is used in line, then, typically, the plates are not changed so frequently as to nullify the advantages of the digital printing method used to impart highly customizable graphics to the web. Accordingly, a preferred method of employing a combination of an offset printing method with a digital printing method (such as ink jet printing or digital offset printing), is to employ the offset printing method (such as lithographic or rotogravure process) on a different operating line, perhaps even at a different geographic location. In other words, the web is first unwound, printed using the offset method, and then wound up again. This reel of an offset printed substrate is then moved to the location of the digital printing process (e.g., high speed, ink jet printing), where the reel of the offset printed substrate is then unwound once more, now to be printed with elements of a personalized graphic and other design specifications based on instructions received over a communications network. For example, a personalized, temporary coffin to be used for cremation might have an offset-printed background, such as a depiction of a blue sky with wisps of clouds, or an American flag for veterans, or other such background. This background, which then might be printed on the web to enable the making of a plurality of temporary coffins, each having the same, or substantially the same, background, could be further processed using a digital ink-jet printing operation to dispose one or more personalized panels on the offset-printed background. It should be noted that a background color or depiction might appear on the outside of the container, the inside of the container, or both. Furthermore, digital printing, too, could be used to dispose all personalized panels, graphics, or other images on the personalized container.

The printed web, now with a sequence of personalized panels disposed on the web, each panel corresponding to a set of instructions received over a communications network, is processed further. In one representative version, the web is now rewound to form a reel of the printed substrate. This reel is then moved to another location for further processing (with the second location being at the same general manufacturing site but at a different processing line; or at a different geographic location, perhaps with the further processing done by a different company).

In one representative embodiment, the web is now cut to form separate web portions, with each web portion generally having a different personalized panel disposed thereon. It should be understood, however, that in some cases the personalized panel may be the same for a given sequence of panels (e.g., if the received instructions specify that the same personalized panel and other selected design elements be used to make two or more personalized containers, then the same personalized panel may appear in a sequential set in which the number in the set corresponds to the number of personalized containers that were ordered). The separated web portion could then be further converted into a personalized container directly, with few or no additional components (e.g., if the web is a film, cloth, natural material or any composite thereof; then the film could be folded and joined to itself—such as by heat sealing or fusing—to form a flexible bag into which the remains of the deceased are placed; a releasable closure may be formed into the film, as with the track-like closures used on some flexible bags, or a draw string style closure system). Or the separated web portion can be joined to other components as part of the process for converting the web portion into the personalized container.

In one representative version of the process, the web on which the personalized panel is printed is selected, in part, to help improve or optimize the printing operation, the quality or fastness of the printed image, or some combination thereof. Optimizing the web substrate for printing may mean that the web is not well suited for forming a container using the web alone, apart from other components. In this case, the web portion comprising the personalized panel is joined to other components to form the container. As described elsewhere, this may mean that the web is joined to an already-made container, or portion thereof. For example, a heavier basis-weight paperboard material may be used to form a cylindrical tube. The web comprising the graphic is then attached to this cylinder, perhaps using an adhesive, or using energy in some way (e.g., ultrasonic bonding). This combination may then be wrapped in a heat-shrinkable film or coated with a liquid coating, which is then shrunk and hardened, to form a container having a multi-layer laminate (e.g., with paperboard as the innermost layer; the web comprising the printed panel; and the film and/or liquid coating). In this way the resulting container incorporates a barrier—i.e., the film or coating—that can block or impede the passage of water or water vapor into the container.

Numerous conventional processes may be employed to convert the printed web into a personalized container. For example, various cutting operations may be used to form a web portion that serves as a blank for subsequent folding and joining operations employed to make a box-like container (akin to boxes used to hold various consumer products or music-box like structures). Or the web portion comprising the personalized panel may be joined to a blank that is then subsequently folded and joined to make the container. The term "blank" refers to the pre-cursor form or template, often substantially flat, that is converted into a container. Often blanks, in their laid-flat state, have tabs that extend outward. When the blank is folded and otherwise manipulated, the tabs contact other portions of the blank, such as other tabs, and are often attached to one another using adhesive, thereby forming a 3-dimensional container.

As noted elsewhere, the inventive processes may be employed to make personalized containers including urns, temporary coffins, and boxes for containing memorabilia (i.e., memory-box type containers). It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

I claim:

1. A method of making a personalized funerary container, the method comprising the steps of:

(a) receiving instructions for disposing a personalized panel on the personalized funerary container, (b) printing the personalized panel on a moving, continuous web in accordance with the received instructions, (c) separating a web portion from the continuous web, the web portion comprising the personalized panel, (d) cutting the web portion to form a substantially flat blank comprising the personalized panel, and (e) folding and joining the substantially flat blank comprising the personalized panel into a three-dimensional container defining the personalized funerary container.

2. The method of claim 1 further comprising the step of receiving instructions specifying a sound to be tangibly embodied in the personalized funerary container.

3. The method of claim 1 further comprising the step of receiving instructions specifying an aroma to be tangibly embodied in the personalized funerary container.

4. The method of claim 1 further comprising the step of receiving instructions specifying a texture to be tangibly embodied in the personalized funerary container.

5. The method of claim 1 further comprising the step of transmitting, in a tangible medium, a statement relating one or more therapeutic benefits to the method of making the personalized funerary container.

6. The method of claim 1 wherein the web is paperboard, film, or both.

7. The method of claim 1 wherein the speed of the web when printed is between 100 feet per minute and 2000 feet per minute.

8. The method of claim 1 wherein the personalized funerary container is an urn, a box for memorabilia, or a temporary coffin.

9. The method of claim 1 further comprising the step of processing received instructions to create a visual display of the personalized funerary container on which is disposed the personalized panel.

10. The method of claim 9 in which the visual display is rotatable.

11. The method of claim 9 further comprising the step of transmitting the visual display to a customer's device.

* * * * *